US006713242B2

(12) United States Patent
Burtin

(10) Patent No.: US 6,713,242 B2
(45) Date of Patent: Mar. 30, 2004

(54) METHOD FOR PROCESSING A BLACK-AND-WHITE NEGATIVE RECORDING FILM MATERIAL FOR MOTION PICTURE SOUNDTRACK

(75) Inventor: Jean Burtin, Mol (BE)

(73) Assignee: Agfa-Gevaert, Mortsel (BE)

( * ) Notice: Subject to any disclaimer, the term of this patent is extended or adjusted under 35 U.S.C. 154(b) by 8 days.

(21) Appl. No.: 10/340,940

(22) Filed: Jan. 13, 2003

(65) Prior Publication Data

US 2003/0138743 A1 Jul. 24, 2003

Related U.S. Application Data

(60) Provisional application No. 60/357,864, filed on Feb. 20, 2002.

(30) Foreign Application Priority Data

Jan. 23, 2002 (EP) ..... 02100054

(51) Int. Cl.[7] ..... G03C 5/28
(52) U.S. Cl. ..... 430/401; 430/934
(58) Field of Search ..... 430/401, 934

(56) References Cited

U.S. PATENT DOCUMENTS 5,198,327 A 3/1993 Yamada et al. ..... 430/363
5,955,255 A 9/1999 Gerlach et al. ..... 430/572

FOREIGN PATENT DOCUMENTS

BE 1007901 A3 11/1995
DE 10017849 11/2000
EP 0 607 912 7/1994
EP 0 799 542 6/1997
EP 0 930 533 1/1999

OTHER PUBLICATIONS

European Patent Office, European Search Report, Author—Binder, Application No. 02 10 0054, publication date Jul. 22, 2002.

*Primary Examiner*—Hoa Van Le
(74) *Attorney, Agent, or Firm*—Joseph T. Guy; Nexsen Pruet Jacobs & Pollard, LLC

(57) ABSTRACT

A processing method has been provided for an exposed silver halide black-and-white negative working sound recording film element, said processing method comprising the steps of processing said sound recording film element in a processing apparatus providing processing ability in a daylight environment, said processing method comprising the steps of developing in a time of less than 20 seconds; fixing in a fixer; rinsing and drying; making use of an automatic processing machine, the mentioned processing steps being followed by a step of controlling black-and-white densitometry, therefor providing the processing machine with a densitometer; further recording in a motion picture color print film and processing therein image area frames originating from an exposed and processed color negative recording film and from (an) optical soundtrack(s) originating from a silver halide black-and-white negative working sound recording film element, wherein said film element has been processed, after having been exposed, by the method as claimed.

11 Claims, 2 Drawing Sheets

METHOD FOR PROCESSING A BLACK-AND-WHITE NEGATIVE RECORDING FILM MATERIAL FOR MOTION PICTURE SOUNDTRACK

This application claims the benefit of U.S. Provisional Application No. 60/357,864 filed Feb. 20, 2002.

FIELD OF THE INVENTION

The present invention relates to a solution for processing, inclusive for use of a dedicated apparatus therefor, of a silver halide black-and-white negative recording film material suitable for being printed as motion picture soundtrack on a motion picture print film.

BACKGROUND OF THE INVENTION

Motion picture print film, the film that is shown in movie theaters, commonly employs an optical analog soundtrack along an edge of the film. During projection of the motion picture images, a light source illuminates the analog soundtrack and a photosensor senses the light passing through and modulated by the soundtrack to produce an audio signal that is sent to amplifiers of the theater sound system. While the most common soundtracks are of the "variable area" type wherein the signal is recorded in the form of a varying ratio of opaque to relatively clear area along the soundtrack, "variable density" soundtracks are also known wherein the absolute density is uniformly varied along the soundtrack. Common sound systems incorporate a cell in the projector whose radiant sensitivity peaks at approximately 800–950 nm (depending on the type of photodiode), which detects the predominant infra-red (IR) radiation emitted by common tungsten lamps or red LED's (light emitting diodes).

Digital soundtracks for motion picture films have been more recently introduced, wherein sound information is recorded in a digital format, e.g. comprising small data bit patterns on the film, typically between perforations of the motion picture film (e.g., Dolby® Digital Stereo soundtracks) or along the film edge (e.g., Sony® Dynamic Digital Sound soundtracks). U.S. Pat. Nos. 4,600,280 and 4,461,552, e.g., disclose methods in which digital audio is photographically recorded on motion picture film.

In order to optimize the visual quality of the motion picture image and to improve sound quality of the soundtrack recorded on a motion picture print film after having been printed from the sound negative film, the motion picture and soundtrack are first typically captured or recorded on separate photosensitive films as negative images, wherein the color negative film is characterized by a low contrast in order to provide large exposure latitude, opposite to the black-and-white sound recording negative film material characterized by a high contrast in order to sharply represent sound differences. Both resulting negatives are then printed in synchronization on a motion picture print film in order to form positive images. On account of the very short exposure times which must be given to each separate picture, or frame, in capturing a motion picture image, a camera negative film employing relatively fast silver halide emulsions is typically used to record the motion picture images. In order to reproduce the wide ranges of colors and tones which may be found in various images, the camera film typically also has a relatively low contrast or gamma. Variable area analog soundtracks and digital soundtracks, however, are best recorded with high contrast, relatively slower speed films in order to generate desired sharp images for the sound recording and minimize background noise generated by relatively high minimum densities typically associated with relatively fast camera negative films. Simultaneously printing of a digital and an analog soundtrack moreover requires an adapted filtering differing from each other during the printing process.

Sound recording films typically comprised of silver-based black-and-white films thus remain preferred. Said film is designed to be processed with conventional black-and-white developer solutions to form silver-based black-and-white images, such as, e.g. the D-97 process as specified in Module 15 titled "Processing black-and-white films" of the Kodak Publication H-24 titled "Manual for Processing Eastman Motion Picture Film". In such processes, after exposure, black-and-white images are generally produced by developing silver halide in a black-and-white developer containing a developing agent in order to form a silver image by reducing the exposed silver halide to silver metal. The undeveloped silver halide is removed from the film by "fixing" with aqueous fixer solution having a silver salt dissolving agent. The silver metal remaining in the film represents the image.

A well-known disadvantage of the classically applied D-97 processing chemicals is, besides its long developing time of about 4 to 5 minutes, its lack for stability in laboratories, opposite to stability obtained for color processing in well-experienced standardized color processing labs. The chemical developing solutions are not provided as ready-for-use solutions and should be prepared in the processing laboratory, thereby requiring trained people and an adapted environment, wherein chemicals can be handled without risk for environmental disasters.

Moreover digital soundtracks used in an increasing amount nowadays, are more sensitive to differences in developer compositions (from batch to batch and/or during processing) and there is lack for experience with replenishing measures applied by sound labs. The need to provide a constant quality for black-and-white processing of the sound recording negative film material puts an ever lasting load on the laboratory worker (requiring quite a lot of experience). As quite huge amounts of developer replenisher solutions (in the range form 500 to 650 ml per square meter of film material) are required, the load of the environment is also questionnable.

As a quick and absolute need for quality of digital soundtracks is a "must" nowadays, it is clear that, in order to provide a black-and-white silver halide motion picture sound recording film comprising a support bearing at least one silver halide emulsion layer, spectrally sensitized with a first sensitizing dye providing a peak sensitivity at less than or equal to 600 nm and a second sensitizing dye providing a peak sensitivity above 600 nm, wherein the contrast overall gradient of the film is greater than 3.7, it is not evident that making use of fine monodispersed silver halide grains is sufficient in order to reach the desired image quality in the sound recording film, thus providing a soundtrack having high quality after having been printed on the color positive print film material.

SUMMARY OF THE INVENTION

It is an object of the present invention to provide a processing method and an apparatus for applying said processing method to a sound recording negative-working silver halide photographic film material in order to guarantee stable processing conditions leading to a constant sensitometry for the said sound recording film characterized by a perfectly constant contrast, thus enhancing image quality, translated as sound after having been printed said sound recording film onto a cine color print film material.

It is a further object of the present invention to provide the processed film after having been run in a rapid processing cycle in order to save time and money, as moreover, there is no need of transport to separate tone developing labs.

It is another object of the present invention to provide ability to perform said processing in an office environment, in a compact customer-friendly processing machine, further providing ability to processing in a daylight environment.

Still another object of the present invention is to provide daylight loading from camera to processor, therefore providing the sound recording film in a cassette, said film further having excellent antistatic properties.

A still further object of the present invention is to provide an ecologically more justified processing method, in order to avoid load of the environment by making use of a film coated with lower amounts of silver halide, further requiring lower amounts of chemicals in developer and fixer as well as in their corresponding replenishers.

Other objects of the present invention will become apparent from the detailed description and from the examples hereinafter.

The above mentioned objects have been realized by making use of a processing method having the specific features defined in the main independent claim. Specific features for preferred embodiments of the invention are set out in the dependent claims.

Further advantages and embodiments of the present invention will become apparent from the following description.

Figure 1:
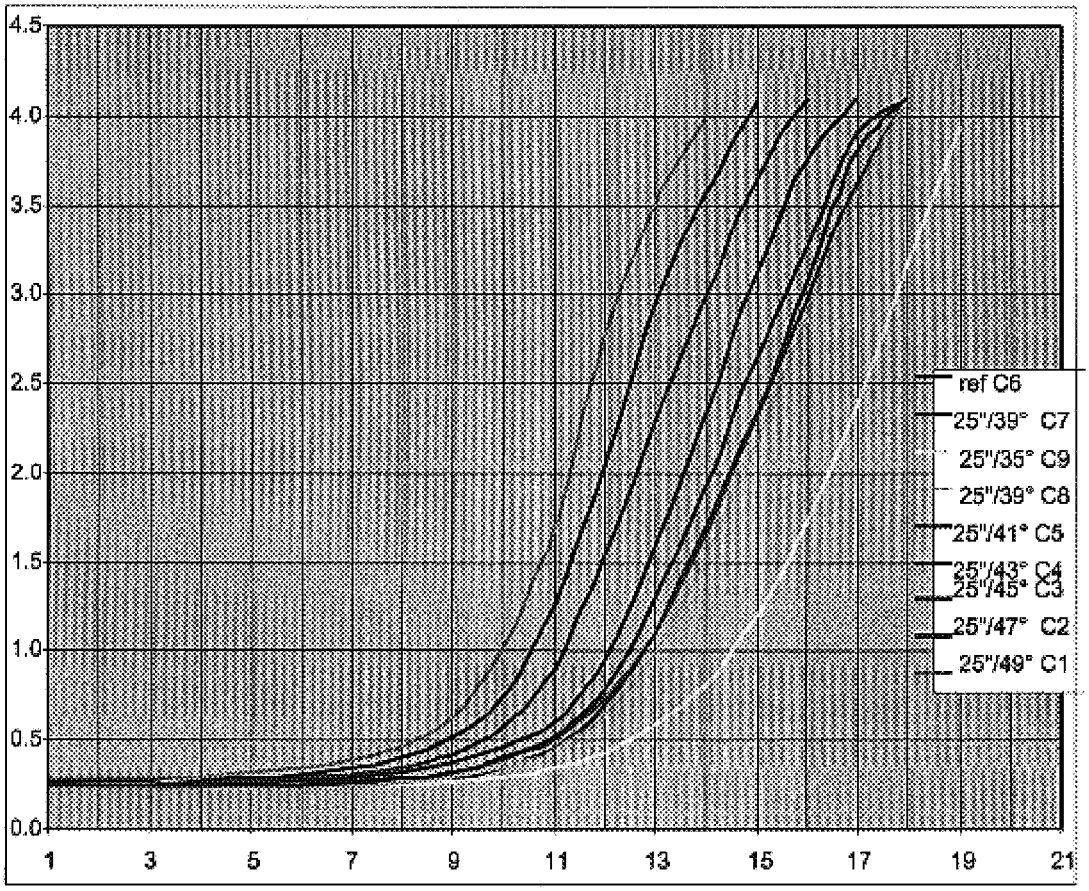
FIG. 1 represents sensitometric curves obtained after having processed during 25 seconds at differing developer temperatures, an exposed ST-9® Sound Recording Film, as a silver halide black-and-white sound recording film, sensitized in the green and in the red wavelength range of the visible light spectrum, in a FP 500 COPEX® processing machine, filled with G3231® as a developer, and G3343® as fixer, all trademarked products from Agfa-Gevaert N. V., Mortsel, Belgium.
Figure 2:
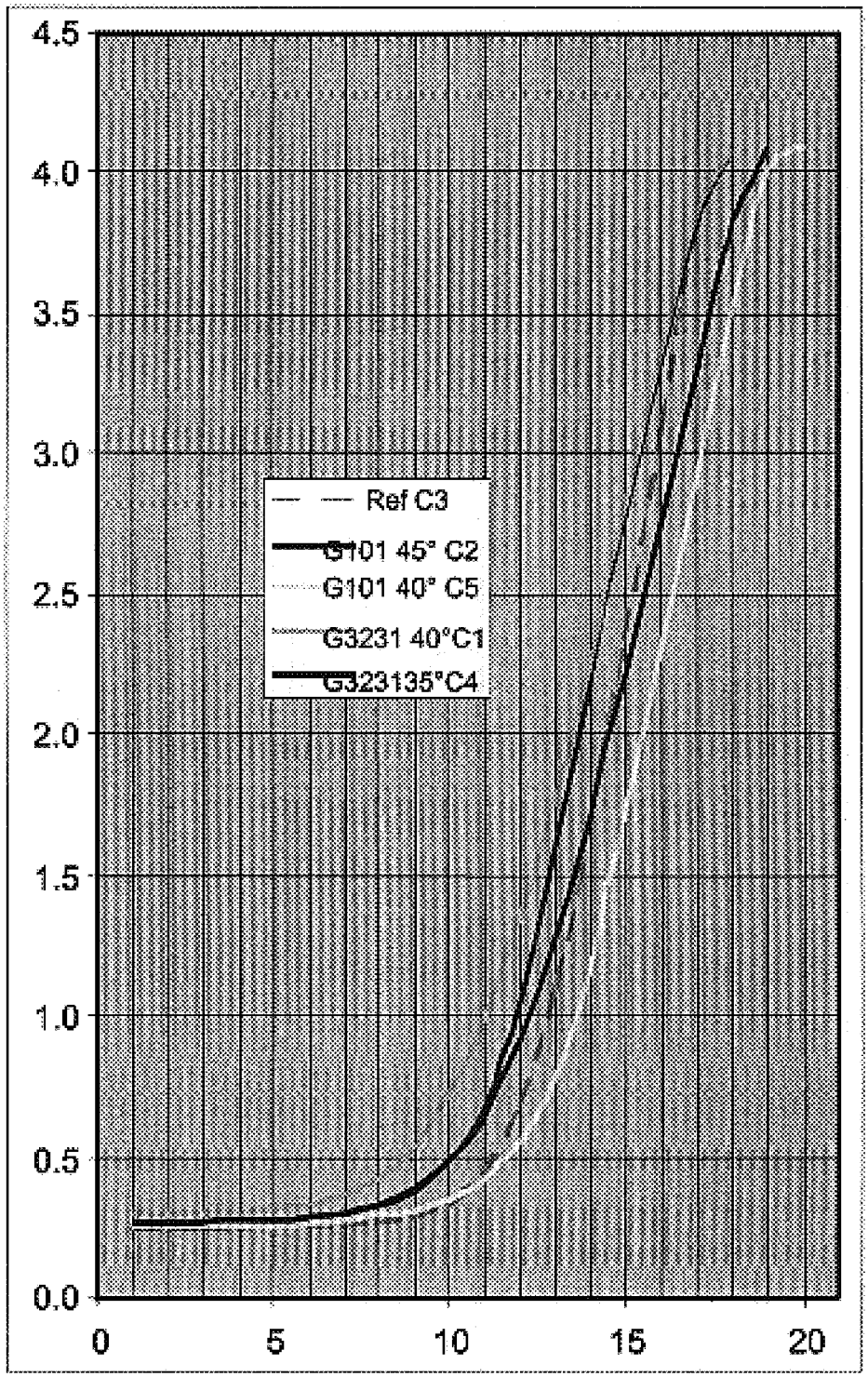
FIG. 2 represents a set of sensitometric curves obtained after having processed the same exposed ST-9® Sound Recording Film as in FIG. 1, during 25 seconds at differing developer temperatures in two different developers being G3231® and G101®, both being developers and trademark products from Agfa-Gevaert N. V., Mortsel, Belgium.

In the FIG. 1 (C6) and FIG. 2 (C2) a reference curve is obtained after having run the same exposed ST-9® Sound Recording Film in standard conditions in the D-97 processing cycle, specified in Module 15 titled "Processing black-and-white films" of the Kodak Publication H-24 titled "Manual for Processing Eastman Motion Picture Film".

DETAILED DESCRIPTION OF THE INVENTION

According to the present invention a processing method is provided for an exposed silver halide black-and-white negative working sound recording film element, said processing method comprising the steps of processing said sound recording film element in a (compact) processing apparatus (in an office environment), providing processing ability in daylight environment, wherein said processing method comprises the steps of developing in a developer within a time of less than 20 seconds, fixing in a fixer, rinsing and drying, wherein said silver halide black-and-white negative working sound recording film element comprises monodispersed cubic silver halide grains rich in silver bromide having an average grain size of less than 0.35 $\mu$m and a coefficient of variation of grain size of less than 40%, wherein said grains have been panchromatically sensitized over a wavelength range from 400 nm up to 750 nm.

As said method proceeds in a total processing time, inclusive for the time inclusive for most time consuming steps like rinsing, and, still more important, drying (in the range of from 0.5 meter up to about 5 meter per minute), the said method seems, at least for the slowest cycle, to be less advantageous than the method as applied known before in the D-97 process. However taking into account the comfortable conditions of an office environment, as well as the absence of time-consuming transport to a separate laboratory and preparation of chemical processing solutions, provides a reduction of total cost to the customer in the whole performing context. Moreover the ecological advantage of a lower consumption of chemicals in a processing method providing much more stability and comfort cannot be denied as besides lower amounts of developer and fixer per square meter, remarkably lower amounts of replenisher and wash water or rinsing water are required, resulting in less environmental load. Lower amounts of replenisher are in an amount of at least three times less than in the D-97 processing mentioned above.

Although a running processing time of about 5 m per minute may look much slower than the common time in the range from 25 up to 50 m per minute, and although it may take about 2 hours before ending processing of a film reel of about 600 m, even for a complete film taking about 5 to 6 reels, the total running processing time of about 10 to 12 hours still remains favourable as no transport, taking at least as much time (and mobilized, stressed people having to perform a "just-in-time" order), is required anymore as processing proceeds in an office environment in a very customer-friendly processing machine, moreover enabling processing in a daylight environment. Presence of the sound recording film in a daylight cassette is preferred: unrolling the film before exposing in order to registrate analog and/or digital sound, followed by rolling up again the exposed film in a daylight cassette doesn't form any problem as opposite thereto an opportunity is offered in order to allow working in daylight conditions in an office environment, without darkroom! Moreover such a daylight cassette may be provided with means, in order to be able to detect the length of exposed and unexposed film respectively, as has e.g. been described in U.S. Pat. Nos. 5,153,625; 5,247,323 and 5,389,992; without however being limited to the method described therein, applied to COM systems. Apart from non-contacting means (e.g. magnets) taking into account the number of windings, other means (e.g. optical means, radial bar codes on a disc at an axial end of a film cassette as in U.S. Pat. No. 5,030,978 or means like an indicator window, formed on a surface of the cassette shell, wherein a rotatable indicator wheel behind the indicator window carries an indication representing a degree of exposure of the photographic film as described in U.S. Pat. No. 5,278,600 can be applied. In another embodiment the amount of film being withdrawn can be monitored by an encoder as has been described in U.S. Pat. No. 5,389,992 or e.g. by means counting the number of perforations and displaying the passed meters of film. Systems providing detection ability of passed film may already have been incorporated in the software of the film camera, providing ability to carry cassettes having variable size, depending on reel length. Those cassettes may be built up so that a part containing the already exposed film may be separated from the other part with unexposed film, wherein the exposed film cassette may be attached to the processing machine in order to provide direct processing ability, while further exposure actions may continue meanwhile.

A preferred machine or very suitable apparatus for processing the exposed black-and-white sound recording film is the FP 500 COPEX® processing machine, trademarked product from Agfa-Gevaert, Mortsel, Belgium, without however being limited thereto as other processing machines, known from graphic or micrographic applications may provide analogous results for a tank content or volume of about 4 liter for the developer solution, 2 liter for the fixer solution and 2 liter and 4 liter for the washing or rinsing tank. Such tank volumes for developer, fixer and washing stations can thus indeed be considered as being "compact", if compared with the large tank volumes of the D-97 developer commonly used until now in order to process sound recording films. Besides the ability of "compact processing" in a daylight of an office environment, the user-friendly processing machine moreover offers an ecological advantage, in that less chemicals, available as stable, "ready-for-use" processing solutions are consumed in the processing cycle, further requiring lower replenishment in amounts of at least 5, more realistic, at least 10 times, and even up to 20 times less than in the formerly applied D-97 processing cycle, moreover offering a quite stable sensitometry and, consequenty, excellent and constant sound quality after printing on the cine color positive print film material.

According to a preferred embodiment of the present invention said silver halide black-and-white negative working sound recording film element comprises monodispersed cubic silver halide grains rich in silver bromide having an average grain size of less than 0.35 $\mu$m and a coefficient of variation of grain size of less than 40%, wherein said grains have been panchromatically sensitized over a wavelength range from 400 nm up to 750 nm as already disclosed above. By said measure of panchromatic sensitization, besides analog soundtracks as formerly obtained after exposure to white light sources, multiple digital soundtracks with light sources having peak wavelengths in the green and red regions can be recorded on a single silver halide black-and-white negative working sound recording film element, suitable for use in the method of the present invention. Sound information recorded in digital format as is known from the DOLBY® Dynamic Digital Stereo Sound and SONY® Dynamic Digital Sound soundtrack systems together with conventionally known analog soundtrack indeed make use of an optical design to photographically record digital data in multiple formats as well as analog soundtrack, in real time, such as at the conventional "real time" rate of 24 frames per second on a negative working black-and-white silver halide motion picture material, suitable for being printed on a "positive" color print film. As the DOLBY® Dynamic Digital Stereo Sound system is sensitive to green light (wherefore ST-8D® Sound Recording Film, trademarked product from Agfa-Gevaert N. V., Mortsel, Belgium, can advantageously be used), whereas the SONY® Dynamic Digital Sound system is sensitive to red light (emitted by red LEDs), and as analog soundtracks cannot be denied yet as being dependent on the projection system available at the movie theaters, it is clear that photographically recording digital data in each of two or more different formats as well as analog audio soundtrack, in real time on a single motion picture film, requires spectral sensitization in both the green as well as the red visible wavelength range of the spectrum, providing optimized spectral sensitivities at 580 nm and 670 nm for the green and red range respectively. Said desire was formulated in WO 97/08586 from SONY Corporation and was well known at the time of filing (August 1995) to Agfa-Gevaert, which resulted in the ST-9® Sound Recording Film, trademarked product from Agfa-Gevaert N. V., Mortsel, Belgium.

The black-and-white silver halide photographic sound recording film material used in the processing method of the present invention is, in its light-sensitive layer(s), coated with monodispersed cubic silver halide grains. Said monodispersed cubic silver halide grains rich in silver bromide, may, in principle, comprise silver chloride.

In the method according to the present invention said monodispersed cubic silver halide grains rich in silver bromide have a silver bromoiodide composition, wherein an average grain size is less than 0.35 $\mu$m, more preferably less than 0.30 $\mu$m, and wherein said coefficient of variation of grain size is at most 40% and, more preferably, less than 30%. In a preferred embodiment said monodispersed cubic silver halide grains rich in silver bromide have a silver bromoiodide composition containing silver iodide in the range from 0 mole % up to 3 mole %, wherein an average grain size is in the range from 0.22 to 0.28 $\mu$m, and wherein said coefficient of variation of grain size is in the range from 15 to 25%.

Said emulsions are surface-sensitive or unfogged internal latent image-forming emulsions, i.e., emulsions that form latent images primarily on the surface of the silver halide grains in order to provide negative-working emulsions such as surface-sensitive emulsions. The silver halide grains of the emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in Research Disclosure, Item 308119, Section III, published Dec. 1, 1989.

Silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, styryls, merostyryls, and streptocyanines. Illustrative spectral sensitizing dyes are disclosed in U.S. Pat. No. 2,430,558 and other references cited in Research Disclosure, Item 308119, Section IV. In accordance with the invention, the sound recording film emulsions are effectively spectrally sensitized both below and above 600 nm, i.a. over a wavelength range of 400 nm to 750 nm. This may be accomplished with one or a mixture of sensitizing dye(s), said one or each dye providing a broad sensitivity peak for the sensitized emulsion which spans substantial portions of both the green (e.g., 500–600 nm) and red (e.g., 600–750) regions of the spectrum, or through use of multiple sensitizing dyes providing peak sensitivities both above and below 600 nm. In a preferred embodiment, the sound recording film emulsions are spectrally sensitized with a first green spectral sensitizing dye providing a peak sensitivity at less than or equal to 600 nm and a second red spectral sensitizing dye providing a peak sensitivity above 600 nm. Such first and second dyes are preferably used in combination in order to spectrally sensitize a single silver halide emulsion, but may alternatively be used to sensitize separate emulsions, which may then be combined and coated in a single layer or coated in separate layers. In a preferred embodiment of the invention, the sound recording film is spectrally sensitized with green and red spectral sensitizing dyes providing peak sensitivities at about 580 nm and at about 670 nm. In further embodiments of the invention, the sound recording film may also be sensitized to the infrared and/or ultraviolet regions of the electromagnetic spectrum.

In a particular embodiment it is possible however to make use of only one spectral sensitizer in order to cover the desired wavelength range, provided that the contrast overall gradient of the film is greater than 3.7 and, more preferably more than 3.8 or even more than 3.9. The sound recording film used in the processing method of the present invention is preferably spectrally sensitized in order to require less than $2.3\times10^{-4}$ J/m$^2$, more preferably less than $0.21\times10^{-4}$ J/m$^2$, and most preferably less than $0.20\times10^{-4}$ J/m$^2$ of energy at wavelengths of 580 nm and 670 nm, and more preferably for all wavelengths throughout the green and red regions of the electromagnetic spectrum.

In the method according to the present invention, it is clear that coated amounts of silver halide are important in order to provide the expected overall contrast set forth above. Said monodispersed cubic silver halide grains thus are present in an amount, expressed as an equivalent amount silver nitrate in the range from 3.0 up to 7.0 g/m$^2$, more preferably from 4.0 up to 6.0 g/m$^2$ and even more preferred about 5.5±0.5 g/m$^2$. It is clear that the maximum densities obtained after processing are decisive for the ultimate coating amounts as requested.

A black and white negative working silver halide photographic sound recording film is thus used, said film comprising a support bearing at least one silver halide emulsion layer, wherein said film is spectrally sensitized both above and below 600 nm as disclosed in U.S. Pat. No. 5,955,255, thus being panchromatically sensitized as formerly described in GB 449,546 and the corresponding FR 784,027. Such film may be used for recording multiple optical soundtracks by exposing said film with a first source of radiation having a peak wavelength of less than or equal to 600 nm, recording a second digital soundtrack by exposing said film with a second source of radiation having a peak wavelength of greater than 600 nm, and processing said exposed film to form first and second digital soundtrack silver images. Suitable antihalation dyes, selected e.g. from the dyes or pigments given hereinbefore may advantageously be coated in an antihalation undercoat. Typical black-and-white sound recording films designed for recording analog soundtracks comprise relatively fine grains as disclosed above, moreover having the desired monodispersity, thus providing a high contrast overall gradient being greater than 3.7, more preferably greater than 3.8 and even most preferably greater than 3.9, desirable for recording a soundtrack with sharp edges. In order to reach such high gradations in a short processing time it is advantageous to develop said sound recording film having fine emulsion grains rich in silver bromide in a developer known from graphic arts or micrographic applications, such as the G3231® or G101® developer, both being trademarked product from Agfa-Gevaert N. V., Mortsel, Belgium, followed by fixing in a fixer such as the G3343®, also trademarked product from same manufacturing company. Said developer comprises a combination of hydroquinone/phenidone as developing agent, but presence of ascorbic acid and/or methol as an alternative developing agent or combination of agents is not excluded. The said fixer is known to have ammonium thiosulfate as a fixing agent, able to dissolve non-exposed areas on the film (quite a very huge percentage, in the range of more than 90% and even more than 95% of the film material as only a very small track has to be developed on the film, normally having a width of 35 mm. The fixing time can thus necessarily be prolonged, but the time of drying (after rinsing) will normally be most decisive. Presence of a rinsing step after developing may be useful.

Short developing times in the range of less than 20 seconds, and even in the range from 10 to 15 seconds, clearly provide an opportunity to make use in the sound laboratory of compact processors in form of a daylight processor having a developer tank volume of about 5 liters. Such a low volume may be more critical with respect to control of the temperature, but nowadays this should form no objection in view of the advantages, considered as a whole, offered by the method of the present invention.

White light sources such as tungsten lamps have conventionally been used to record analog soundtracks. Accordingly, the native sensitivity of many silver halide emulsions in the blue region of the electromagnetic spectrum (e.g., 380–500 nm) has formerly been sufficient for such white light recording. Where additional speed is desired for white light recording or where emulsions are used which lack sufficient native sensitivity in the visible light region, sound recording films have been sensitized for analog recording with blue and/or green sensitizing dyes. As nowadays digital soundtrack recording is typically performed by exposing a sound recording film to a modulated radiation light source having a narrow band width, such as a modulated laser beam (e.g. for analog soundtrack) or light emitting diode or diode array, sound recording films have nowadays been performed in order to be optimally spectrally sensitized so as to provide a peak sensitivity to match a particular digital recording device, along with providing adequate sensitivity for recording analog soundtracks with white light sources. It is thus clear that the method of the present invention is applicable to sound recording films providing ability to analog sound recording, to digital sound recording (in the green and/or the red wavelength range of the spectrum) and to universally recording sound films, providing application for analog as well as digital sound recording in the broadest sense.

Sound recording films are exposed to tungsten light in a sound recorder to capture the latent image of an analog sound pattern. The typical equivalent shutter speeds of commercial analog soundtrack recorders are in the order of $10^{-6}$ second exposure time. Typical digital recording exposure times using lasers or light emitting diodes range from $10^{-4}$ s to $10^{-6}$ s.

According to the method of the present invention the processing steps mentioned before are followed by a step of controlling black-and-white densitometry. This measure is particularly preferred in order to control the density obtained for the exposed and processed film and to guarantee a constant control: deviations from the desired sensitometry are most preferably corrected by changes in temperature of the developer as will be illustrated in the examples hereinafter.

According to the present invention use is made of an automatic processing machine in order to perform processing of an exposed silver halide black-and-white negative working sound recording film element by the method according to the present invention as described hereinbefore. Ability to work in an office environment in daylight conditions is offering a particular advantage.

According to the present invention an automatic processing machine provided with a densitometer in order to perform all steps, inclusive for processing steps and the step of controlling black-and-white densitometry according to the method of the present invention. Such a configuration advantageously leads to the control of the required densitometry (sensitometry) for the processed silver halide black-and-white sound recording film element as described before as a constant high quality is required for the sound recording film in order to get a soundtrack, characterized by a high and constant quality, on the color print film as end product, ready to be projected and viewed in a movie theater.

According to the present invention a method has further been provided for forming a soundtrack image in a motion picture print film, said method comprising the steps of recording a soundtrack negative in a silver halide sound recording film material processed following the method according to the method as claimed hereinbefore, and printing said soundtrack onto a negative-working motion picture print film by exposing the said motion picture print film through the soundtrack negative and processing the exposed print film in order to form a positive soundtrack, together with framed pictures (image area frames) from a negative recording film, printed onto the said print film. In a preferred embodiment both said negative recording film and said motion picture print film are color films.

A color print film material provided with a soundtrack printed from a sound recording film according to the present invention, preferably has an antihalation undercoat comprising one or more dye(s), preferably absorbing scattered light, and wherein at least one dye is a yellow non-diffusing dye that absorbs blue light and is removable and/or decolorizable in a processing bath, and wherein optionally other dyes present are covering the spectrum in order to absorb radiation in the green and red wavelength range. The said yellow dye, which is required in the antihalation undercoat layer, as the blue sensitive emulsion layer is coated as closest light-sensitive layer, is preferably chosen from the group consisting of merostyryl dyes and monomethine oxonol dyes, wherein further said merostyryl dyes preferably are pyrazolone-5 merostyryl dyes having a hydroxybenzal moiety and at least one carboxy or carbamoyl group on the pyrazolone ring or symmetrical monomethine oxonols of pyrazolone. Particularly preferred is a yellow non-diffusing merostyryl dye (I) or a monomethine oxonol dye (II) as disclosed in U.S. Pat. No. 4,770,984, without however being limited thereto. Said dyes may be added to the antihalation coating composition in form of a gelatinous dispersion, a colloidal silica dispersion or a (gelatinous or colloidal silica) solid particle dispersion, as disclosed e.g. in EP-A 0 569 074.

According to another embodiment said motion picture projection color print film material, comprises a transparent film support and coated thereon in succession, a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an antistress layer, wherein between said support and said blue-sensitive silver halide emulsion layer a yellow antihalation undercoat is provided, which comprises at least one yellow non-diffusing dye that absorbs blue light and is removable and/or decolorizable in a processing bath. As already set forth hereinbefore said at least one dye is preferably chosen from the group consisting of a merostyryl dye and a monomethine oxonol dye, preferably being a (symmetrical) monomethine oxonol, and even more preferably a pyrazolone-type monomethine oxonol dye, whereas preferred merostyryl dyes are of the pyrazolone-5-type, having a hydroxybenzal moiety and at least one carboxy or carbamoyl group on the pyrazolone ring.

In still another embodiment said color print film material has, between said blue-sensitive silver halide emulsion layer and said red-sensitized silver halide emulsion layer, a bluish antihalation intermediate layer, which comprises at least one blue non-diffusing dye that absorbs red light and is removable and/or decolorizable in a processing bath. Said at least one blue non-diffusing dye is at least one pentamethine oxonol-type barbituric acid derivative dye, without however being limited thereto. Preferred pentamethine oxonols of the barbituric acid type preferably have at least one halogen atom, hydroxy, alkyl, alkoxy, carboxy, carbamoyl, sulphamoyl, alkoxycarbonyl, aryloxycarbonyl, alkoxysulphonyl, aryloxysulphonol, and heterocyclylsulphonyl, e.g. o-sulphamoyl-phenyl, p-methoxy-phenyl, and 3-hydroxy-4-carboxyphenyl groups.

In order to provide excellent subtitling properties for such color print material, the antihalation undercoat of said material or element comprises a high temperature boiling solvent.

In a further preferred embodiment said color print film material has a high temperature boiling solvent, which is present in a total amount of from 0.1 $g/m^2$ up to not more than 0.5 $g/m^2$.

Antihalation dyes as mentioned hereinbefore can also be present in the backing layer arrangement, and more particularly in the layer between subbing layer and topcoat layer, present as backing layer comprising the lubricant, providing the desired friction coefficient before and after processing, the value of which remains within a range between 0.20 and 0.30 when measured versus stainless steel as set forth hereinbefore. Also in color negative films same antihalation dye layers may be provided as has been described e.g. in EP-A 0 582 000 or, in the alternative, in a film wherein use is made of only one cyan-colored filter dye containing layer as in U.S. Pat. No. 5,723,272. Other antihalation dyes suitable for use in color print materials are those given hereinafter, which can moreover advantageously be used e.g. in a sound recording film wherein an antihalation layer may be provided, e.g. containing more than one dye, as a yellow pigment, a blue pigment, a red dye and/or a mixture of at least two of those dyes or pigments. Said sound recording film, coated on a clear base support, although containing the commonly applied dyes, preferably contains a yellow pigment, a red pigment and a blue pigment.

In order to avoid loss of conductivity and loss of durability, especially with respect to scratching stability, the problems of which have been set out EP-A 1 202 115, it is recommended for the color print film material as well as for the black-and-white sound recording silver halide photographic film element to comprise on the light-sensitive side of a transparent polyester support an electrically conductive subbing layer, an antihalation undercoat, a light-sensitive multilayer arrangement or single emulsion layer respectively, and a protective overcoat; and on a backing layer side opposite thereto, in order, a subbing layer containing a lubricant and a topcoat layer, characterized in that on the light-sensitive side of said element said subbing layer comprises an antistatic agent providing a substantially unchanged electrical resistivity of the said element before and after processing of said material, and wherein said antihalation undercoat optionally comprises a high temperature boiling solvent; whereas on the backing layer side a friction coefficient of the backing layer versus stainless steel remains unchanged in the range between 0.20 and 0.30 before and after processing of said material, even after removal of the said topcoat layer during processing in an alkaline developer. Preferably the subbing layer at the light-sensitive side has, as an antistatic agent providing an unchanged electrical resistivity of this subbing layer before and after processing of said material, a polythiophene compound, incorporated in said subbing layer(s) or in the alternative, a metal oxide compound, said metal being selected from the group consisting of tin, indium tin, vanadium, zinc, manganese, titan, indium, silicium, magnesium, barium, molybdene and tungsten, whether or not combined with the said polythiophene compound. Thereby, said electrical resistivity is between $1\times10^5$ and $1\times10^{12}$ Ω/□, measured as described in Research Disclosure June 1992, item 33840 for said subbing layer, as layer having the lowest resistance. Otherwise said lubricant is present in at least the subbing layer of the non-light-sensitive backing layer and is a compound selected from the group consisting of carnaubawax, montanwax, polyethylene, a fluorinated polymer, a silicon polymer, higher alcohol esters of fatty acids, higher fatty acid calcium salts, metal stearates, water dispersible siloxane-containing polyurethane formed from prepolymer containing anionic and non-anionic hydrophilic groups, and paraffins. Moreover said topcoat layer of the non-light-sensitive backing layer comprises polystyrene sulfonic acid in an amount of from 20 up to 50 mg/m$^2$.

According to the present invention a method for recording and processing image area frames originating from an exposed and processed color negative recording film and from (an) optical soundtrack(s) originating from a silver halide black-and-white negative working sound recording film element, processed, after being exposed, by the method as claimed hereinbefore, in a motion picture color print film comprising a support bearing blue, green, and red light sensitive silver halide emulsion dye forming layers and one or more antihalation layer(s), and reading the optical soundtrack(s), said method comprising the steps of recording and processing image area frames and an optical soundtrack in a color print film material by imagewise exposing said emulsion layers in accordance with desired image area frames; exposing one of said blue, green, or red light sensitive silver halide emulsion layers in accordance with an analog and/or digital soundtrack, and processing the exposed film to yield corresponding dye images in the exposed image area frames besides (an) analog and/or digital soundtrack(s); wherein said soundtrack(s) is(are) recorded and developed in a single photosensitive dye forming emulsion layer of the print film, and wherein said film is processed to yield (a) dye-only, silverless analog and/or digital soundtrack(s), the soundtrack region of the film not being subjected to any specialized processing treatment relative to the image area frame region, and reading the dye-only soundtrack using a narrow band light source the wavelength of which coincides with the peak absorbance wavelength of the soundtrack dye.

According to the method of the present invention said color print film comprises a transparent film support and coated thereon in succession, a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an antistress layer, wherein between said support and said blue-sensitive silver halide emulsion layer a yellow antihalation undercoat is provided, which comprises at least one yellow non-diffusing dye that absorbs blue light and is removable and/or decolorizable in a processing bath and between said blue-sensitive silver halide emulsion layer and said red-sensitized silver halide emulsion layer a bluish antihalation intermediate layer is provided, which comprises at least one blue non-diffusing dye that absorbs red light and is removable and/or decolorizable in a processing bath. More preferred embodiments for the said film material have been disclosed in U.S. Pat. No. 4,770,984, already mentioned hereinbefore, which is incorporated herein by reference.

EXAMPLES

While the present invention will hereinafter be described in connection with preferred embodiments thereof, it will be understood that it is not intended to limit the invention to those embodiments.

Experiment No. 1

As a silver halide black-and-white sound recording film, sensitized in the green and in the red wavelength range of the visible light spectrum, the ST-9® Sound Recording Film, trademarked product from Agfa-Gevaert N. V., Mortsel, Belgium, was taken.

After exposure the ST-9 black-and-white sound recording film was processed in a FP 500 COPEX® processing machine, trademarked product from Agfa-Gevaert, Mortsel, Belgium, filled with G3231® as developer, and G3343® as fixer, both trademarked products from Agfa-Gevaert N. V., Mortsel, Belgium.

The film was processed in the said processing machine during 25 seconds at differing developer temperatures and the resulting sensitometric curves obtained after said processing were represented in FIG. 1 (C1 at 49° C., C2 at 47° C., C3 at 45° C., C4 at 43° C., C5 at 41° C., C7 at 39° C., C8 at 39° C. and C9 at 35° C., wherein the curves have been numbered at a density D=3.0 from the left side to the right side at the abcis axis), besides the reference curve (C6) obtained for the same material in the commonly used D-97 processing cycle.

It can be concluded from the sensitometric curves in FIG. 1 that in the short processing cycle run according to the method of the present invention the sensitometric curves obtained perfectly match with the reference curve, and that simple temperature control of the solutions in the processing machine offers excellent and constant sensitometry and high soundtrack quality as desired.

Experiment No. 2

The same film as in the foregoing experiment was processed in the said processing machine during 25 seconds at differing developer temperatures and in two different developers being G3231® and G101®, both well-know as developers trademarketed by Agfa-Gevaert, Mortsel, Belgium. The resulting sensitometric curves obtained after processing in both developers were represented in FIG. 2 (C1 at 40° C. in G3231, C2 at 45° C. in G101, C4 at 35° C. in G3231, C5 at 40° C. in G101) wherein the curves have been numbered at a density D=3.0 from the left side to the right side at the abcis axis), besides the reference curve (C3), obtained for the same material in the commonly used D-97 processing cycle, wherein developer and fixer were those well-know to be applied therein during the standard time and at the standardized temperature applied in the said D-97 processing cycle.

It can be concluded from the sensitometric curves in FIG. 2 that in the short processing cycle run according to the method of the present invention the sensitometric curves obtained perfectly match with the reference curve, irrespective of the choice of the developer, only determined by simple temperature control of the developer solutions in the processing machine. An excellent and constant sensitometry and high soundtrack quality as desired is obtained again.

Having described in detail preferred embodiments of the current invention, it will now be apparent to those skilled in the art that numerous modifications can be made therein without departing from the scope of the invention as defined in the appending claims.

What is claimed is:

1. Method of processing an exposed silver halide black-and-white negative working sound recording film element, comprising monodispersed cubic silver halide grains rich in silver bromide having an average grain size of less than 0.35 μm and a coefficient of variation of grain size of less than 40%, wherein said grains have been panchromatically sensitized over a wavelength range from 400 nm up to 750 nm, said processing method comprising the steps of processing said sound recording element in a processing apparatus providing processing ability in daylight environment, wherein said processing method comprises the steps of developing in a developer within a time of less than 20 seconds, fixing in a fixer, rinsing and drying.

2. Method according to claim 1, wherein said monodispersed cubic silver halide grains rich in silver bromide have a silver bromoiodide composition, wherein an average grain size is less than 0.30 $\mu$m, and wherein said coefficient of variation of grain size is at most 30%.

3. Method according to claim 1, wherein said monodispersed cubic silver halide grains rich in silver bromide have a silver bromoiodide composition containing silver iodide in the range from 0 mole % up to 3 mole %, wherein an average grain size is in the range from 0.22 to 0.28 $\mu$m, and wherein said coefficient of variation of grain size is in the range from 15 to 25%.

4. Method according to claim 1, wherein said monodispersed cubic silver halide grains are present in an amount, expressed as an equivalent amount silver nitrate in the range from 4.0 up to 6.0 g/m$^2$.

5. Method according to claim 1, wherein said processing steps are followed by a step of controlling black-and-white densitometry.

6. Method for forming a soundtrack image in a motion picture print film, said method comprising the steps of recording a soundtrack negative in a silver halide sound recording film material processed following the method according to claim 1, and printing said soundtrack onto a negative-working motion picture print film by exposing the motion picture print film through the soundtrack negative and processing the exposed print film.

7. Method for forming a soundtrack image in a motion picture print film, said method comprising the steps of recording a soundtrack negative in a silver halide sound recording film material processed following the method according to claim 5, and printing said soundtrack onto a negative-working motion picture print film by exposing the motion picture print film through the soundtrack negative and processing the exposed print film.

8. Method for recording and processing image area frames originating from an exposed and processed color negative recording film and from (an) optical soundtrack(s) originating from a silver halide black-and-white negative working sound recording film element, processed, after being exposed, by the method according to claim 1, in a motion picture color print film comprising a support bearing blue, green, and red light sensitive silver halide emulsion dye forming layers and one or more antihalation layer(s), and reading the optical soundtrack(s), said method comprising:

recording and processing image area frames and an optical soundtrack in a color print film material by imagewise exposing said emulsion layers in accordance with desired image area frames, exposing one of said blue, green, or red light sensitive silver halide emulsion layers in accordance with an analog and/or digital soundtrack, and processing the exposed film to yield corresponding dye images in the exposed image area frames besides (an) analog and/or digital soundtrack(s); wherein said soundtrack(s) is(are) recorded and developed in a single photosensitive dye forming emulsion layer of the print film, and wherein said film is processed to yield (a) dye-only, silverless analog and/or digital soundtrack(s), the soundtrack region of the film not being subjected to any specialized processing treatment relative to the image area frame region, and reading the dye-only soundtrack using a narrow band light source the wavelength of which coincides with the peak absorbance wavelength of the soundtrack dye.

9. Method for recording and processing image area frames originating from an exposed and processed color negative recording film and from (an) optical soundtrack(s) originating from a silver halide black-and-white negative working sound recording film element, processed, after being exposed, by the method according to claim 5, in a motion picture color print film comprising a support bearing blue, green, and red light sensitive silver halide emulsion dye forming layers and one or more antihalation layer(s), and reading the optical soundtrack(s), said method comprising:

recording and processing image area frames and an optical soundtrack in a color print film material by imagewise exposing said emulsion layers in accordance with desired image area frames, exposing one of said blue, green, or red light sensitive silver halide emulsion layers in accordance with an analog and/or digital soundtrack, and processing the exposed film to yield corresponding dye images in the exposed image area frames besides (an) analog and/or digital soundtrack(s); wherein said soundtrack(s) is(are) recorded and developed in a single photosensitive dye forming emulsion layer of the print film, and wherein said film is processed to yield (a) dye-only, silverless analog and/or digital soundtrack(s), the soundtrack region of the film not being subjected to any specialized processing treatment relative to the image area frame region, and reading the dye-only soundtrack using a narrow band light source the wavelength of which coincides with the peak absorbance wavelength of the soundtrack dye.

10. Method according to claim 8, wherein said color print film comprises a transparent film support and coated thereon in succession, a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an antistress layer, wherein between said support and said blue-sensitive silver halide emulsion layer a yellow antihalation undercoat is provided, which comprises at least one yellow non-diffusing dye that absorbs blue light and is removable and/or decolorizable in a processing bath and between said blue-sensitive silver halide emulsion layer and said red-sensitized silver halide emulsion layer a bluish antihalation intermediate layer is provided, which comprises at least one blue non-diffusing dye that absorbs red light and is removable and/or decolorizable in a processing bath.

11. Method according to claim 9, wherein said color print film comprises a transparent film support and coated thereon in succession, a blue-sensitive silver halide emulsion layer comprising a yellow-forming coupler, a red-sensitized silver halide emulsion layer comprising a cyan-forming coupler, an intermediate layer, a green-sensitized silver halide emulsion layer comprising a magenta-forming coupler, and an antistress layer, wherein between said support and said blue-sensitive silver halide emulsion layer a yellow antihalation undercoat is provided, which comprises at least one yellow non-diffusing dye that absorbs blue light and is removable and/or decolorizable in a processing bath and between said blue-sensitive silver halide emulsion layer and said red-sensitized silver halide emulsion layer a bluish antihalation intermediate layer is provided, which comprises at least one blue non-diffusing dye that absorbs red light and is removable and/or decolorizable in a processing bath.

* * * * *